US006733304B1

(12) United States Patent
Liao

(10) Patent No.: US 6,733,304 B1
(45) Date of Patent: May 11, 2004

(54) ELECTRICAL CONNECTOR ASSEMBLY WITH STRENGTHENED FIXING POSTS

(75) Inventor: Fang-Jwu Liao, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/463,978

(22) Filed: Jun. 17, 2003

(30) Foreign Application Priority Data

Jan. 22, 2003 (TW) ..... 92201191 U

(51) Int. Cl.[7] ..... H01R 12/00
(52) U.S. Cl. ..... 439/66; 439/525; 439/71
(58) Field of Search ..... 439/66, 71, 79, 439/70, 569, 570, 33, 78, 567, 378, 379, 381, 680, 525

(56) References Cited

U.S. PATENT DOCUMENTS 5,674,078 A * 10/1997 Davis et al. ..... 439/79
5,793,618 A * 8/1998 Chan et al. ..... 361/809
6,027,345 A * 2/2000 McHugh et al. ..... 439/66
6,146,151 A * 11/2000 Li ..... 439/66
6,146,152 A * 11/2000 McHugh et al. ..... 439/66
6,164,978 A * 12/2000 McHugh et al. ..... 439/66
6,168,477 B1 * 1/2001 Shih et al. ..... 439/733.1
6,293,806 B1 * 9/2001 Yu ..... 439/66
6,425,767 B1 * 7/2002 Lin ..... 439/65

* cited by examiner

*Primary Examiner*—Tho D. Ta
*Assistant Examiner*—Edwin A. Leon
(74) *Attorney, Agent, or Firm*—Wei Te Chung

(57) ABSTRACT

An electrical connector assembly (1) includes a base (2), and a frame (3) assembled with the base. The base includes two solid cylindrical fixing posts (231) at two diagonally opposite corners thereof. Each fixing post includes a fixing portion (2312) at a top thereof. The frame defines two fixing holes (32), corresponding to the fixing posts. Each fixing hole is surrounded by a step (321) thereat. When the base and the frame are assembled together, the fixing posts are deformably received through the fixing holes, and the fixing portions hook on the steps. Thus the frame and the base are combined together firmly. Because the fixing posts are solid and generally cylindrical, during assembly, the fixing posts can fasten the frame on the base firmly and securely with minimal risk of breakage.

2 Claims, 3 Drawing Sheets

ELECTRICAL CONNECTOR ASSEMBLY WITH STRENGTHENED FIXING POSTS

BACKGROUND OF THE INVENTION

1. Field of the Invention

The present invention relates to an electrical connector assembly used for electrically connecting a land grid array (LGA) integrated circuit (IC) module to a printed circuit board (PCB), and particularly to such electrical connector assembly which provides excellent joining between the sub-parts thereof.

2. Description of the Prior Art

An electrical connector assembly used for electrically connecting an LGA electrical component to a PCB is widely applied in the field of electronics, and a correlative article is found in *Nonlinear Analysis Helps Design LGA Connectors* (Connector Specifier, February 2001). Such electrical connector assemblies are disclosed in U.S. Pat. Nos. 6,027,345, 6,146,151, 6,146,152, 6,164,978 and 6,293,806.

FIG. 4 shows such a conventional electrical connector assembly 6, comprising a frame 61 and a base 62 fixed with the frame 61. The frame 61 defines a pair of orientation holes 611 on two opposite sides thereof respectively, and a plurality of recesses 612 in two adjacent sides thereof. The frame 61 further defines two fixing holes 613 at the diagonally corners thereof, with each fixing hole 613 being surrounded by a step (not shown) thereat. The base 62 defines a multiplicity of passageways 621 adapted to receive a multiplicity of contacts (not shown). The base 62 defines two forklike fixing members 622 and two orientation posts 624, respectively corresponding to the fixing holes 613 and the orientation holes 611 of the frame 61. In addition, the base further defines a plurality of restricting posts 623 corresponding to the recesses 612 of the frame 61. When the frame 61 and the base 62 are assembled together, the forklike fixing members 622 cooperate with the fixing holes 613 to fix the base 62 on the frame 61 firmly. Because each fixing member 622 is forklike, a portion thereof connecting with the base 62 is relatively weak. The fixing member 622 is liable to rupture during assembly of the frame 61 to the base 62. When this happens, the frame 61 is prone to detach from the base 62. Moreover, it requires using a slide for a mold design to form the forklike fixing member 622, which will increase the manufacturing cost in molding.

Hence, a new electrical connector assembly is required to overcome the above-described disadvantages.

SUMMARY OF THE INVENTION

An object of the present invention is to provide an electrical connector assembly having securely combined sub-parts.

In order to achieve the aforementioned object, an electrical connector assembly in accordance with a preferred embodiment of the present invention comprises a base and a frame assembled with the base. The base comprises two generally cylindrical fixing posts at two diagonally opposite comers thereof. Each fixing post is generally a solid column, but with a planar surface on a circumferential periphery thereof. Each fixing post comprises a top fixing portion. The frame defines two fixing holes corresponding to the fixing posts. Each fixing hole is surrounded by a step thereat. When the base and the frame are assembled together, the fixing posts are deformably received through the fixing holes respectively, and the fixing portions hook on the steps. Thus the frame and the base are combined together firmly and securely. Because the fixing posts are solid and generally cylindrical, in assembly, the fixing posts can fasten the frame on the base firmly and securely with minimal risk of breakage.

Other objects, advantages and novel features of the present invention will become more apparent from the following detailed description when taken in conjunction with the accompanying drawings.

DESCRIPTION OF THE PREFERRED EMBODIMENT

Figure 1:
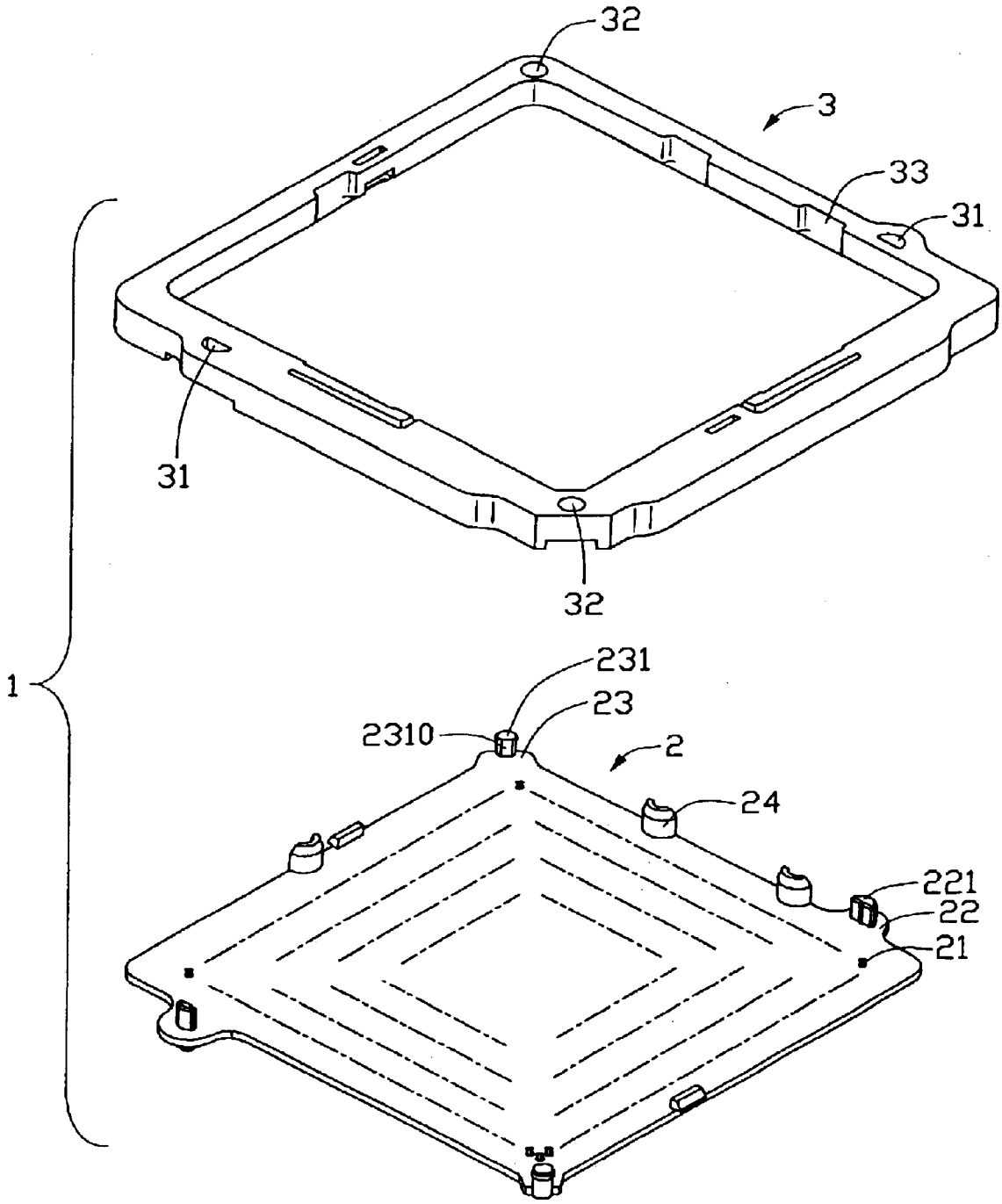
FIG. 1 is a simplified, exploded isometric view of an electrical connector assembly in accordance with the preferred embodiment of the present invention.

Reference will now be made to the drawing figures to describe the present invention in detail.

Figure 2:
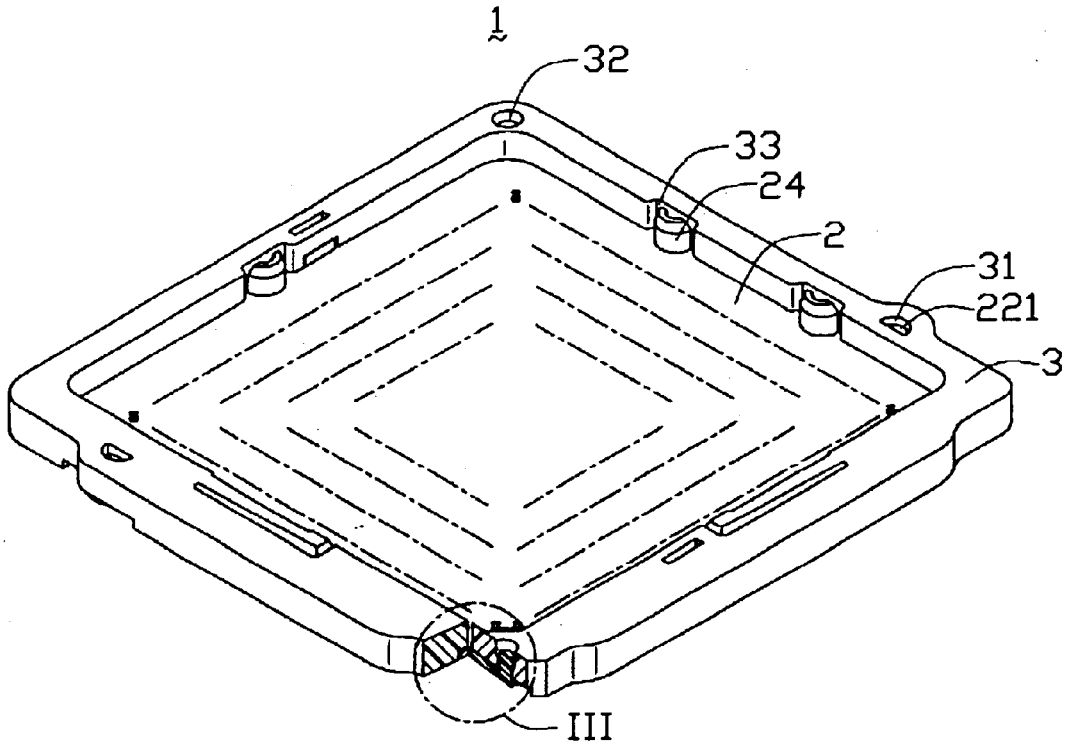
FIG. 2 is an assembled view of FIG. 1, with the electrical connector assembly partly cut away.
Figure 3:
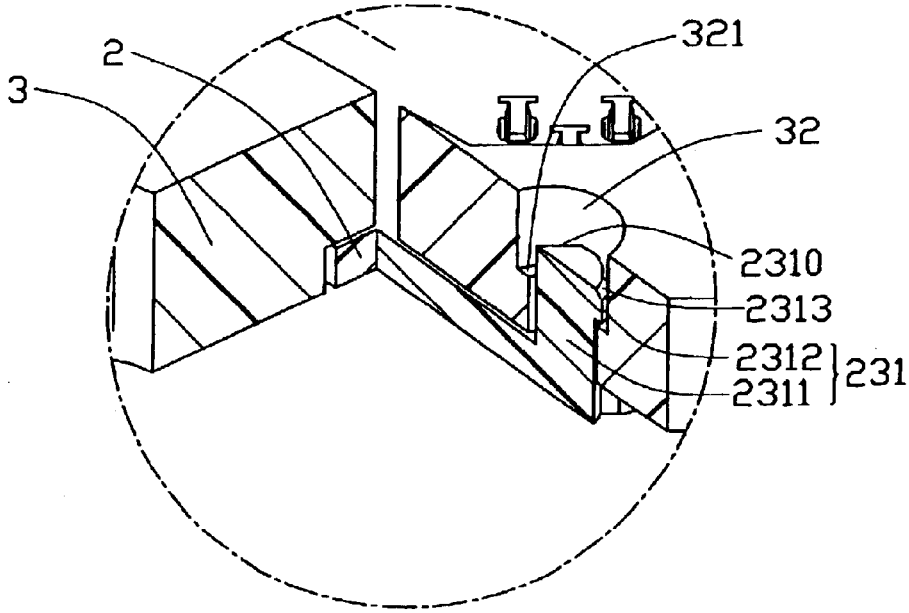
FIG. 3 is an enlarged view of a circled portion III of FIG. 2.
Figure 4:
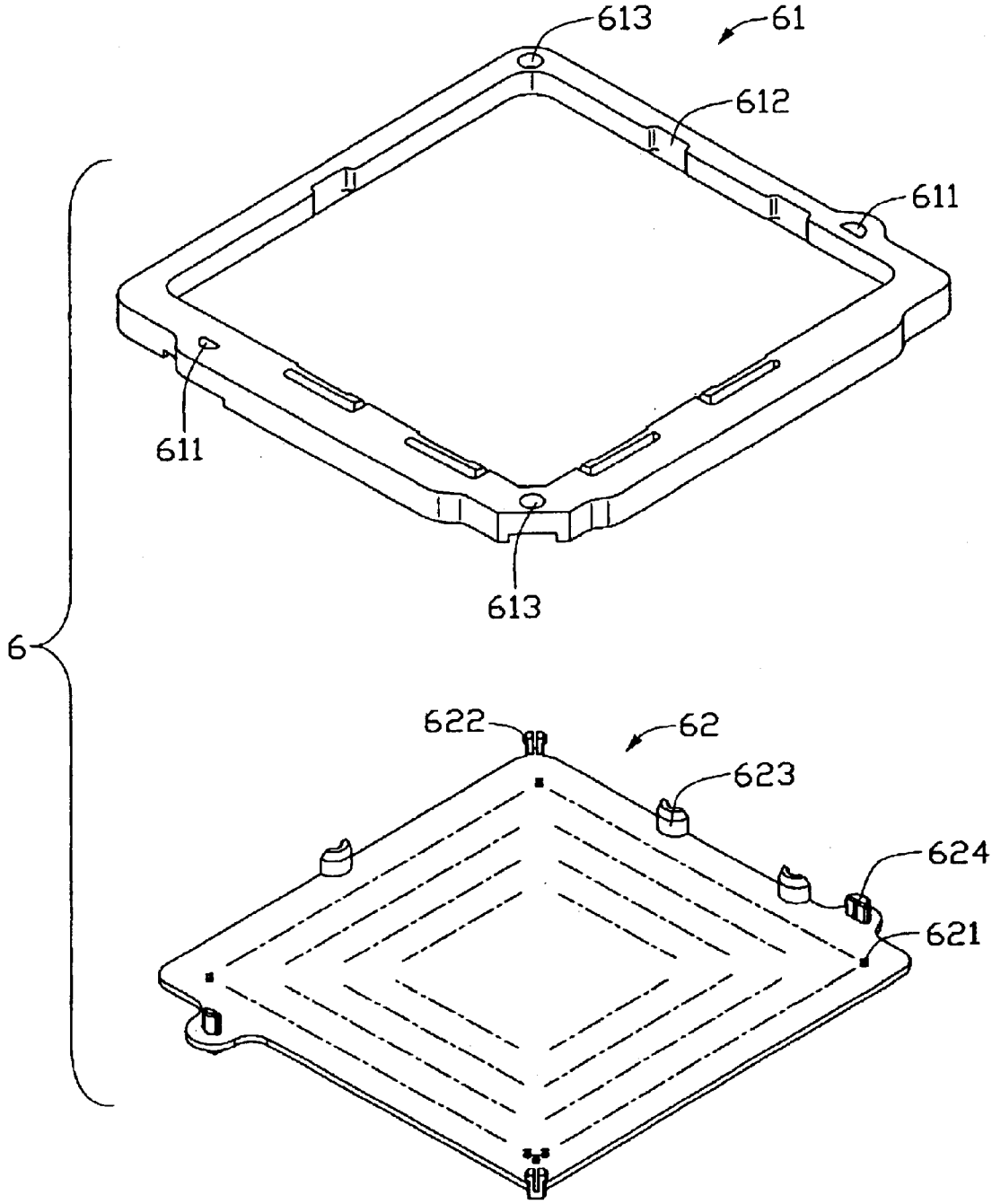
FIG. 4 (PRIOR ART)
FIG. 4 is a simplified, exploded isometric view of a conventional electrical connector assembly.

Referring to FIGS. 1~3, an electrical connector assembly 1 of the present invention is used for connecting an LGA IC module (not shown) to a PCB. The electrical connector assembly 1 comprises a generally rectangular base 2, and a frame 3 assembled with the base 2.

The base 2 defines a multiplicity of passageways 21 therein, the passageways 21 being adapted to receive a multiplicity of electrical contacts (not shown) therein. The base 2 comprises a pair of first projections 22 on each of opposite sides thereof respectively. Each first projection 22 forms a generally semi-cylindrical orientation post 221 thereon. The base 2 also comprises a pair of second projections 23 at two opposite diagonally corners thereof respectively. Each second projection 23 forms a fixing post 231 thereon. Each fixing post 231 is generally a solid column, but with a planar surface 2310 facing the center of the base 2 on a circumferential periphery thereof, said surface being parallel to a central longitudinal axis of the fixing post 231. In this embodiment, the planar surface 2310 is also normal to the diagonal line where the pair of fixing posts 231 are commonly located. The fixing post 231 comprises a connecting portion 2311 extending from the base 2, and a fixing portion 2312 protruding perpendicularly from the outer semi-circumference portion of the connecting portion 2311 wherein such an outer semi-circumference portion is symmetrical relative to the aforementioned diagonal line. That is, a diameter of the fixing portion 2312 is greater than a diameter of the connecting portion 2311. The fixing portion 2312 defines a guide chamfer 2313 at a top thereof. Because the fixing portion 2312 only extends along an outer semi-circumference of the post 231, the base 2 is permitted to extend around the fixing post 231 with an inner semi-circumference joint therebetween under the normal vertical mold design without using the additional lateral slide mold, thus maximizing the strength between the base 2 and the fixing post 231 while keeping the lower manufacturing cost. In addition, the base 2 comprises a plurality of restricting posts 24 at two adjacent sides thereof.

The frame 3 defines two orientation holes 31 corresponding to the orientation posts 221 of the base 2, and two fixing holes 32 corresponding to the fixing posts 231 of the base 2. Each fixing hole 32 is surrounded by a circumferential step 321 thereat. In addition, the frame 3 defines a plurality of recesses 33, corresponding to the restricting posts 24 of the base 2.

Referring particularly to FIGS. 2 and 3, when the base 2 and the frame 3 are assembled together, the orientation posts 221 are interferentially received through the orientation holes 31, the fixing posts 231 are deformably received through the fixing holes 32, and the recesses 33 receive the restricting posts 24. The restricting posts 24 are used for restricting a position of the IC module (not shown). When the fixing posts 231 have been fully received in the fixing holes 32, the fixing portions 2312 elastically rebound to their original shapes, and accordingly hook on the corresponding steps 321. Because the fixing posts 231 are solid and the base 2 extends around the fixing post 231 to reach semi-circumference joint therebetween, in assembly, the fixing posts 231 can fasten the frame 3 on the base 2 firmly and securely with minimal risk of breakage.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector assembly used for electrically connecting an IC module to a printed circuit board, comprising:

a generally rectangular base defining a multiplicity of passageways, a plurality of orientation posts and a plurality of solid fixing posts, each of the fixing posts having a connecting portion connecting with the base and a fixing portion extending from the connecting portion;

a frame conjoined with the base and defining a plurality of orientation holes and fixing holes engagingly receiving the orientation posts and the fixing posts respectively; wherein each of the fixing posts is generally a solid column, but with a planar surface on a periphery thereof, said surface being parallel to a central longitudinal axis of the fixing post, the orientation posts are arranged at the two opposite sides of the base, and each of the orientation posts is generally semi-cylindrical, the fixing posts are defined at two diagonally opposite corners of the base, the fixing portion defines a guide chamfer thereon and wherein each of the fixing holes of the frame is a surrounded by a step thereat.

2. An electrical connector assembly comprising:

a rectangular planar insulative base defining a plurality of passageways therein;

at least a pair of fixing posts extending integrally upwardly from two opposite ends of a diagonal line of said base;

a plurality of terminals disposed in the corresponding passageways, respectively;

a rectangular insulative frame having a similar dimension and shape with the base and downwardly conjoined with the base to cover a peripheral region of the base while upwardly exposing the passageways; and at least a pair of fixing holes formed at two opposite diagonal corners of the frame and receiving the fixing posts, respectively; wherein said pair of fixing posts define a pair of outwardly radially protruding fixing portions along outer semi-circumferences, respectively, and the base and the corresponding fixing post define therebetween a junction around an inner semi-circumference of said fixing post opposite to the corresponding outer semi-circumference, said outer semi-circumference and the corresponding inner semi-circumference are divided by an imaginary plane which is perpendicular to said diagonal line, said fixing posts respectively define a pair of flattened surfaces facing to each other along said diagonal line, said fixing posts are of a solid type and a width of each of said flattened surfaces is smaller than a diameter of the corresponding fixing post.

* * * * *